US007712197B2

(12) United States Patent
Stündl

(10) Patent No.: US 7,712,197 B2
(45) Date of Patent: May 11, 2010

(54) METHOD AND APPARATUS FOR CRIMPING A MULTIFILAMENT THREAD

(75) Inventor: Mathias Stündl, Wedel (DE)

(73) Assignee: Oerlikon Textile GmbH & Co. KG (DE)

( * ) Notice: Subject to any disclaimer, the term of this patent is extended or adjusted under 35 U.S.C. 154(b) by 0 days.

(21) Appl. No.: 12/433,413

(22) Filed: Apr. 30, 2009

(65) Prior Publication Data

US 2009/0249765 A1 Oct. 8, 2009

Related U.S. Application Data

(63) Continuation of application No. PCT/EP2007/061264, filed on Oct. 22, 2007.

(30) Foreign Application Priority Data

Nov. 4, 2006 (DE) ..... 10 2006 052 058

(51) Int. Cl.
*D02G 1/12* (2006.01)

(52) U.S. Cl. ..... 28/266; 28/221; 28/256; 28/257

(58) Field of Classification Search ..... 28/220, 28/221, 247, 250, 254–257, 258, 263, 262, 28/265, 266–268, 248; 264/168, 211.12, 264/210.8, 211.14
See application file for complete search history.

(56) References Cited

U.S. PATENT DOCUMENTS 3,311,961 A * 4/1967 Iwnicki et al. ..... 28/250
3,464,096 A * 9/1969 Mcintyre ..... 28/251
3,478,401 A * 11/1969 Whitworth et al. ..... 28/281
4,118,843 A * 10/1978 Schippers et al. ..... 28/255
4,301,578 A * 11/1981 Dammann et al. ..... 28/256
4,765,042 A * 8/1988 Li et al. ..... 28/257
4,908,919 A * 3/1990 Irvine ..... 28/250
5,974,777 A * 11/1999 Davis ..... 57/290
6,983,519 B2 * 1/2006 Wirz ..... 28/266
7,150,083 B2 * 12/2006 Schemken et al. ..... 28/266
7,386,925 B2 * 6/2008 Germer ..... 28/263

FOREIGN PATENT DOCUMENTS

DE 1813196 A1 7/1969
DE 2709680 A1 9/1978
EP 0003952 A 9/1979

* cited by examiner

*Primary Examiner*—Amy B Vanatta
(74) *Attorney, Agent, or Firm*—BainwoodHuang

(57) ABSTRACT

A method and an apparatus involves crimping a multifilament thread, wherein the thread which is produced by melt spinning is compressed to a thread plug. The thread plug is cast on the circumference of rotating processing drum for thermal treatment and is wrapped around the circumference of the processing drum with many side-by-side wraparounds. Following that, the thread plug is unravelled in an unravelling area on the circumference of the processing drum into the crimped thread which is pulled of the processing drum. To obtain a continuous and regular unravelling of the thread plug with multiple wraparounds and mutual touching of the wraparounds of the thread plug, the thread is guided at a slant from the unravelling area of the thread plug such that a growing axial space appears between the thread and the thread plug, on the circumference of the processing drum, during increasing wraparounds of the thread on the circumference of the processing drum.

20 Claims, 4 Drawing Sheets

METHOD AND APPARATUS FOR CRIMPING A MULTIFILAMENT THREAD

CROSS REFERENCE TO RELATED APPLICATIONS

This Patent Application is a Continuation of International Patent Application No. PCT/EP2007/061264 filed on Oct. 22, 2007, entitled, "METHOD AND APPARATUS FOR CRIMPING A MULTIFILAMENT THREAD", the contents and teachings of which are hereby incorporated by reference in their entirety.

TECHNICAL FIELD

Embodiments of the invention relate to methods for crimping a multifilament thread as well as devices for carrying out such methods.

BACKGROUND

It is generally known to initially extrude a plurality of restiform filaments from a thermoplastic melt during the production of crimped synthetic threads. The filament bundle is combined after cooling to form a smooth multifilament thread. In order to produce crimping in the individual filament strands, the multifilament thread is compressed into a thread plug. For this purpose, the filaments of the thread are preferably conveyed through a hot fluid, and deformed into loops and arcs at the surface of the thread plug. In order to fix the crimping forming in the filaments, the thread plug is thermally treated. In the case where the thread plug formation occurs by hot fluid, the thread plug heated in this manner is subsequently cooled. For this purpose the thread plug is guided at the circumference of a processing drum. The processing drum is driven in a rotating manner so that the dwell time for cooling the thread plug is determined substantially by both the circumferential speed of the processing drum, and by the degree of the wraparounds of the thread plug at the circumference of the processing drum. Since the circumferential speed of the processing drum is determined by processing speeds and can be modified only to a limited degree, the intensive cooling may be achieved only by respective wraparounds of the thread plug at the processing drum.

A method and a device are known from DE 38 00 773 C2, which discloses that the thread plug is guided in multiple wraparounds at the circumference of the processing drum. For this purpose the wraparounds of the thread plug are guided in a direct side-by-side manner at the circumference of the processing drum, such that reciprocal influences of the individual filaments of the thread plug are inevitable.

SUMMARY

A loose connection of the filaments within the thread plug can result in individual filaments getting stuck to each other in the adjacent wraparounds of the thread plug at the circumference of the processing drum, particularly in the case of thread plugs having a respectively low thread plug density. Such sticking together has an adverse effect, especially during the unraveling of the thread plug into a crimped thread, such that irregularities occur at the crimped thread, which are particularly evident in a fluctuating thread tension during the unraveling of the crimped thread. Such thread tension fluctuations have a very adverse effect, especially on the after-treatment of the thread, such as by twirling.

Embodiments of the present invention are therefore directed to further improve a method and a device for crimping a generic, multifilament thread such that it enables a safe and even unraveling of the thread plug into a crimped thread after thermal treatment of the thread plug having multiple side-by-side wraparounds at the circumference of a processing drum.

Embodiments of the invention include guiding the thread at a slant from the unraveling area of the thread such that an increasing axial space appears between the thread and the thread plug on the circumference of the processing drum during increasing wraparounds of the thread on the circumference of the processing drum.

It has been surprisingly found that the individual filament strands have no substantial differences in composition and crimping even with a non-linear transition of the thread plug into the crimped thread. However, even the filament strands that are stuck to the adjacent wraparound of the thread plug are integrated into the filament connection of the crimped thread without any irregularities during the unraveling, due to the removal of the crimped thread from the thread plug end at a slant. Due to the course of the crimped thread facing away from the wraparounds of the thread plug on the processing drum, different actions of forces are created in the unraveling area between in inner side of the thread plug, which directly faces the adjacent wraparounds of the thread plug, and an outer side of the thread plug for forming the thread. In this manner, particularly the partial areas of the filament strands placed in the inner area of the thread plug are drawn more intensely than the partial areas placed in the outer area, which substantially facilitates the unraveling of possible individual overlapping locations between the individual wraparounds of the thread plug at the circumference of the processing drum. In this regard the thread plug can be evenly transferred into the crimped thread.

In order to obtain conditions in guiding the thread and the unraveling of the thread plug that are as stable and even as possible, a further improvement of one embodiment of the invention of guiding the thread into an unraveling groove at the circumference of the processing drum after unraveling of the thread plug has proven particularly successful. In this manner reproducible and even operating conditions and straight grains can be achieved.

As a function of the thickness of the thread plug, which has a direct effect on the reciprocal influencing of the thread plug wraparounds at the circumference of the processing drum, different straight grains may be selected during the unraveling of the thread plug. However, it has been shown that the thread should be guided at the circumference of the processing drum at a gradient angle, if possible, which exceeds an angle of 10°. Depending on the looseness of the thread plug the gradient angle may be increased, where maximum gradient angles of 80° should not be exceeded.

It is of particular importance for the after-treatment of the crimped thread that a sufficient thread tension is created at the thread. For this purpose, one embodiment of the invention advantageously provides a further improvement in that the thread is guided between the unraveling area and a removal area across a wraparound area at the circumference of the processing drum, which includes a circumferential angle of at least 45°. In this manner the only minimal tensile forces required for unraveling the thread plug as opposed to the thread tensile forces required for the after-treatment can be realized. For example, no substantial tensile force acting upon the thread is desired in the unraveling area of the thread plug. The thread tensile force required for the after-treatment of the crimped thread could be, for example, 100 cN.

It has been proven particularly successful for the after-treatment, if the crimped thread is twirled into a spool before wrapping, and is twirled after removal from the processing drum by a twirling unit. In this manner the bond of the crimped filaments may be advantageously improved in the thread connection for further processing.

In order to be able to carry out the forming of the thread plug and the thermal treatment of the thread plug at a flexibility that is as high as possible, one embodiment of the method variation has proven particularly successful, in which the thread plug is conveyed by a conveyor device for the unraveling on the circumference of the processing drum, where the conveyor device and the processing drum are driven independently of one another. The thickness and the guide speed of the thread plug can be adjusted both via the conveyor device and via the processing drum.

A device is provided in order to carry out the embodiments of the method of the invention. The device according to embodiments of the invention includes a guiding apparatus for guiding the crimped thread at the circumference of the processing drum at a slant from the unraveling area of the thread plug such that an increasing axial space appears between the thread and the thread plug on the circumference of the processing drum during increasing wraparounds of the thread on the circumference of the processing drum.

Such a guiding apparatus may be formed directly at the circumference of the processing drum. However, it is also possible to embody the apparatus at a distance to the circumference of the processing drum.

It has proven particularly advantageous to form the guiding apparatus via a cast-off groove at the circumference of the processing drum. The cast-off groove is arranged at an axial offset to a guideway receiving the thread plug at the circumference of the processing drum such that a crimped thread guided from the unraveling area of the thread plug at a slant can be directly inserted into the cast-off groove. This results in very stable and reproducible operating conditions and thread guides at the circumference of the processing drum during the unraveling of the thread plug.

For the purpose of the thread guide of the crimped thread at the circumference of the processing drum one embodiment of the device according to the invention has proven particularly advantageous in which a diameter step is embodied at the circumference of the processing drum between the cast-off groove and the guideway. For this purpose the thread is guided across the diameter step at the circumference of the processing drum. In this manner, gradient angles can be realized in the straight grain, which are possible in a range of between 10° and 80°.

In order to be able to guide the crimped thread in the cast-off groove at a defined wraparound, a thread guide is preferably connected downstream of the processing drum, which tensions a guide plane with the cast-off groove. For this purpose a wraparound can be realized depending on the position of the thread guide, which preferably includes at least one circumferential angle of 45° at the circumference of the processing drum.

Since texturing apparatus having compression chambers, being vertically aligned, are usually utilized for forming thread plugs, a further improvement of the device according to one embodiment of the invention is preferably used, in which a supply unit is arranged between the texturing apparatus and the processing drum in order to obtain a transition of the thread plug from the texturing apparatus to the circumference of the processing drum that is as gentle as possible. In this manner the thread plug thicknesses preadjusted in the compression chamber may be left substantially unchanged. The transition toward the circumference of the processing drum is preferably embodied at an acute angle, or tangentially, such that the thread plug may be guided without any substantial supply.

For this purpose, the supply unit is formed by a guide mechanism and a conveyor device, which are combined into a conveyor gap such that the thread plug is conveyed along a slideway formed by the guide mechanism via the engagement of the conveyor device. For this purpose the supply and a conveying of the thread plug can be advantageously combined with little deformation. A defined and controllable discharge speed of the thread plug from the texturing apparatus is possible by the conveyor device such that a constant building up of the thread plug is ensured.

In order to realize multiple wraparounds in a substantially elongated and straight line unraveling of the thread plug at the circumference of the processing drum the embodiments of the invention preferably provide a control member that is arranged in the pivoting direction of the processing drum, at a short distance in front of the guide mechanism, such that the thread plug may be displaced by the control member after a single wraparound at the circumference of the processing drum. In this manner compact guides of the thread plug can be realized at the guideway in the processing drum.

The cooling of the thread plug at the circumference of the processing drum for the thermal treatment is preferably carried out by ambient air. For this purpose the circumference of the processing drum is embodied by a gas permeable guide casing, where low pressure acting upon the environment in the interior of the processing drum is created by a suction device. In this manner, a uniform cooling air flow can be created for flowing through the thread plug at the circumference of the processing drum. As an alternative, or in addition, conditioning of the air or of the thread plug may also be carried out. It is possible to utilize cold air, or to wet the thread plug using a fluid, such as water.

The device according to embodiments of the invention is preferably utilized in a spinning process, in which the crimped thread at the end of the spinning process is wound on a spool. For this purpose it is of particular advantage if an additional twirling of the crimped filaments is carried out before winding. For this purpose a twirling unit is connected downstream of the processing drum, by way of which the filaments of the multifilament crimped thread are twirled after crimping. Multifilament threads or composite threads, such as BCF threads, can be produced within the spinning process. In case of composite threads, such as the so-called tricolor thread, which is formed of three individual partial threads, the thread plug can be created by combining all three partial threads.

Regardless of the composition of the synthetic thread, a conveyor nozzles combined with a compression chamber has been proven as particularly suited as the texturing apparatus. The conveyor nozzle is connected to a compressed air source, and the compressed air is supplied to the conveyor nozzle preferably heated such that a heating of the filaments may take place simultaneously in addition to the conveying of the filaments.

BRIEF DESCRIPTION OF THE DRAWINGS

The embodiments of the invention is described in further detail below based on some example embodiments of the device according to the invention for carrying out the method according to the invention with reference to the attached figures.

They show.

DETAILED DESCRIPTION

Figure 1:
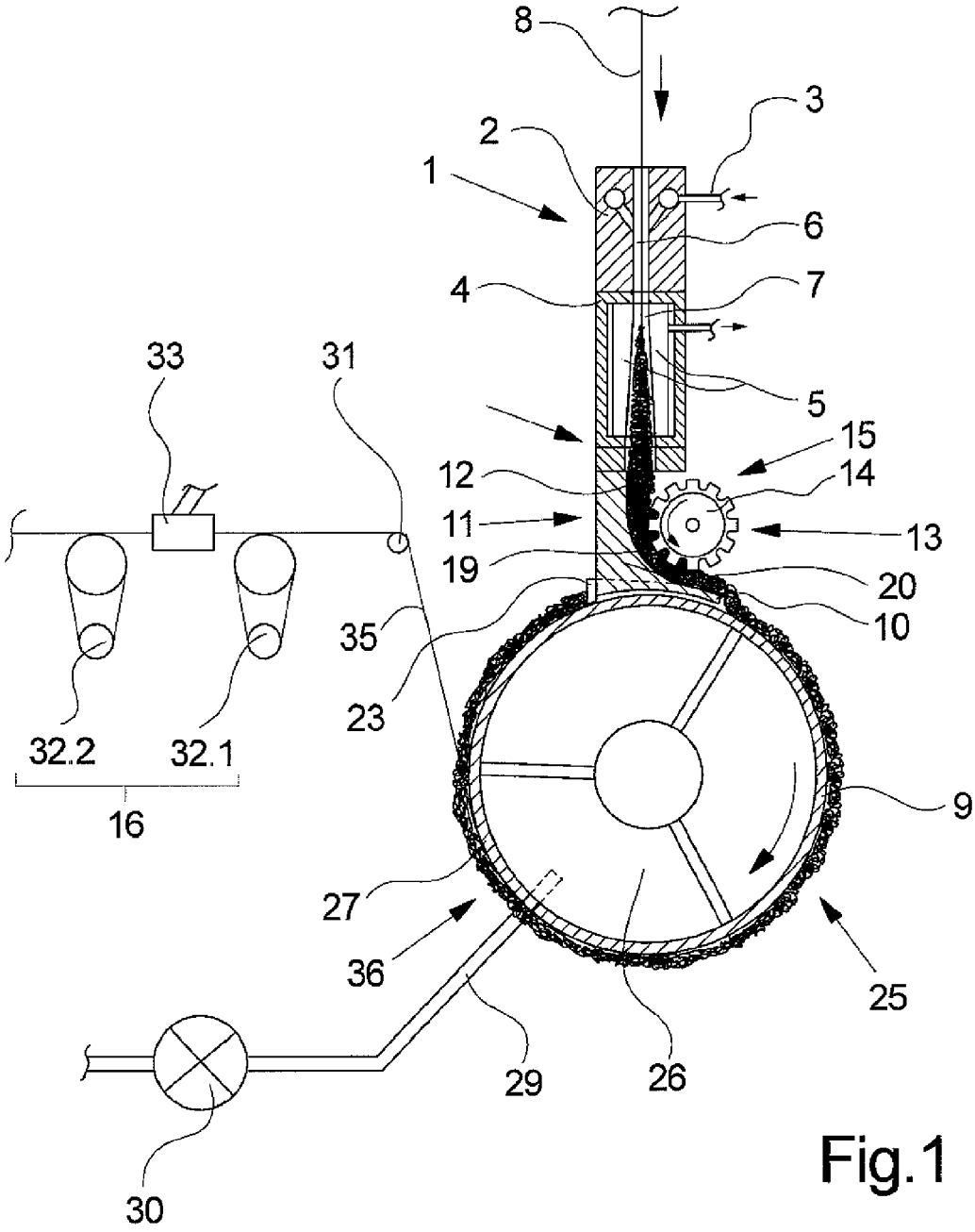
FIG. 1 a schematic cross-sectional view of a first example embodiment of the device according to the invention for carrying out the method according to the invention.
Figure 2:
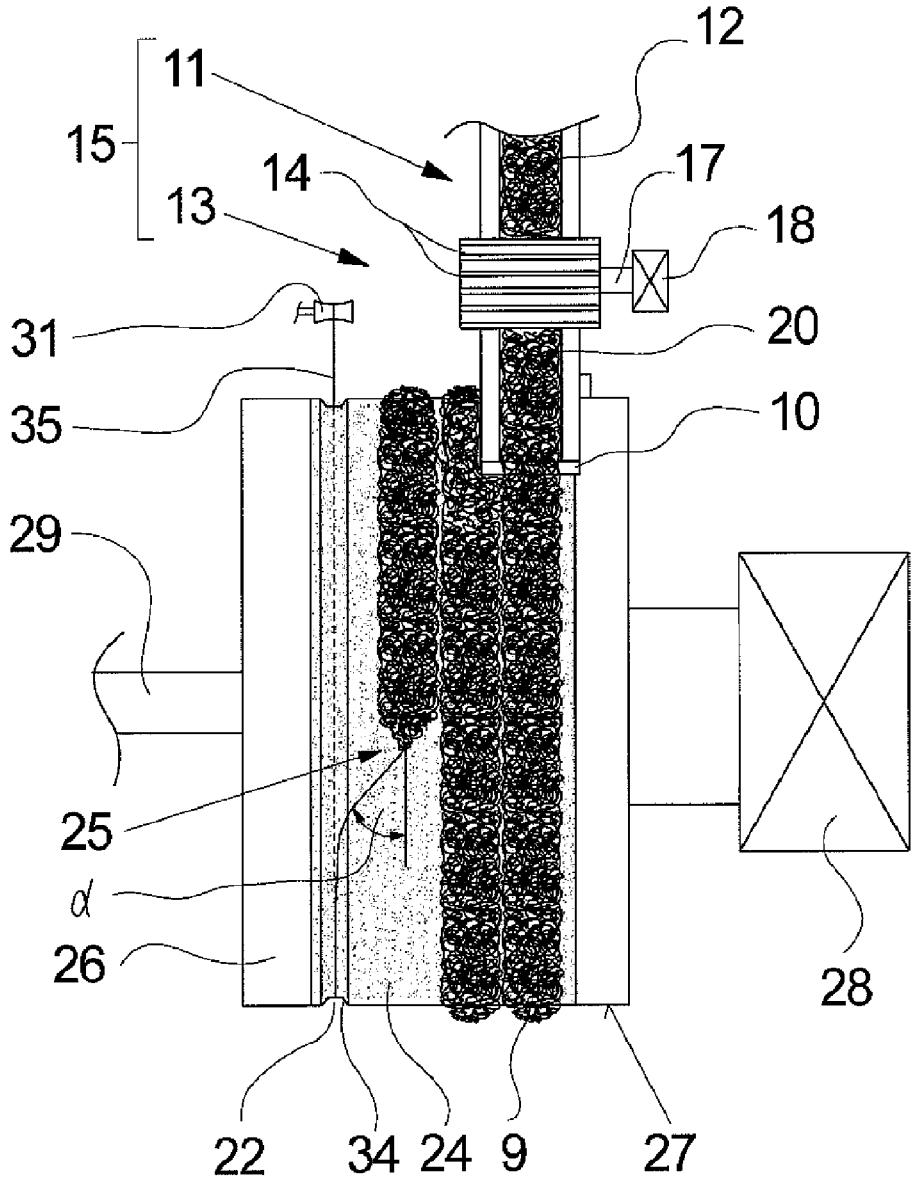
FIG. 2 a schematic side view of the example embodiment of the device according to the invention in FIG. 1.
Figure 3:
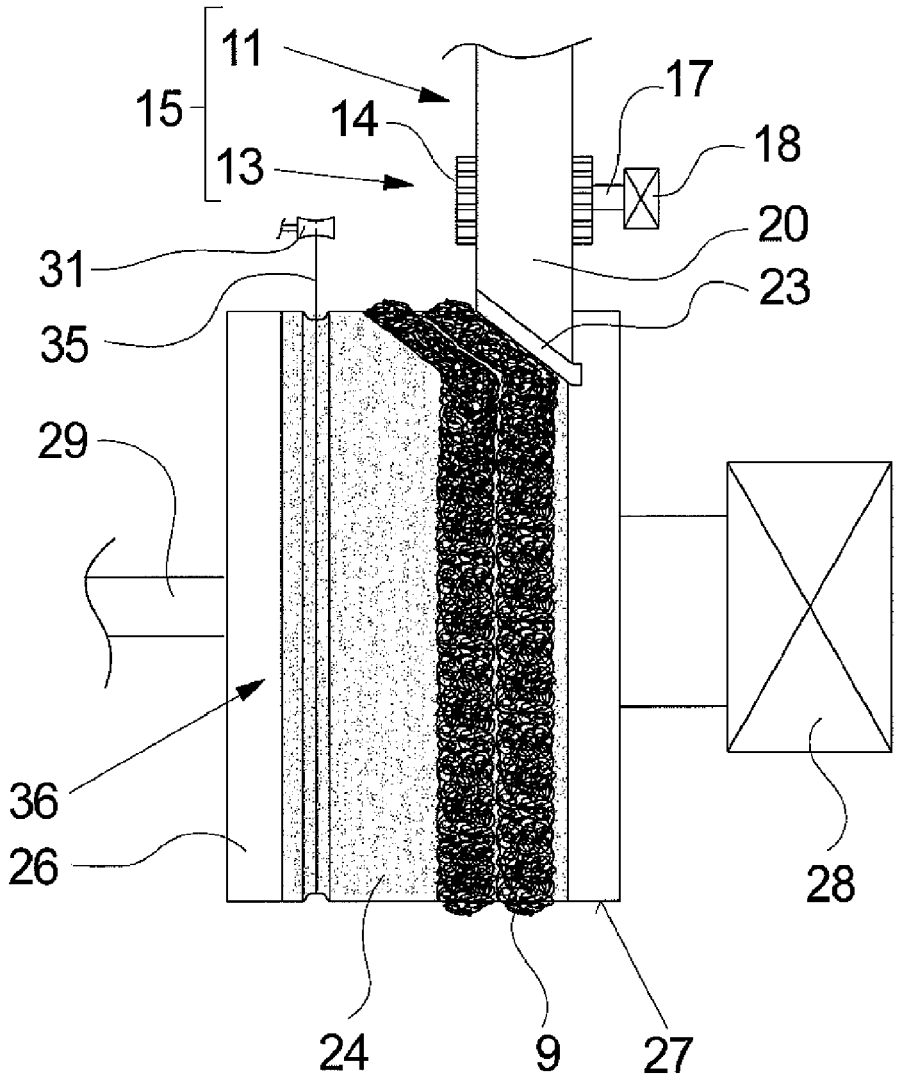
FIG. 3 a schematic rear view of the example embodiment of the device according to the invention in FIG. 1.

FIG. 1, FIG. 2, and FIG. 3 schematically show a first example embodiment of the device according to the present invention for carrying out the method of the present invention for crimping a multifilament thread in multiple views. FIG. 1 schematically shows the device in one view, and FIG. 2 in a side view. FIG. 3 shows the rear view of the example embodiment. Insofar as no reference is made to one of the figures, the following description applies to both figures.

The device, which could be integrated, for example, into a spinning process for the production of a BCF thread, has a texturing apparatus 1 in order to compress a running multifilament thread 8 into a thread plug 9. However, depending on the percentage, the thread 8 could also be formed from one filament bundle, or from multiple filament bundles of multiple partial threads. In this example embodiment, the texturing apparatus 1 is formed by a conveyor nozzle 2 and an adjoining compression chamber 4, as known from WO 03/004743. In this regard express reference is made to WO 03/004743 which is incorporated herein by reference, such that only a short description shall suffice at this point.

The conveyor nozzle 2 has a center thread channel 6, into which a conveyor fluid is introduced. For this purpose the conveyor nozzle 2 is connected to a compressed air source via a fluid connection 3. The conveyor fluid introduced into the thread channel 6, which is preferably formed by compressed air, is heated before the introduction into the conveyor nozzle 2. The multifilament thread 8, which was previously formed from a plurality of extruded filaments, is suctioned into the conveyor nozzle 2 by the compressed air entering into the thread channel 6 under pressure, and conveyed along the thread channel 6.

The compression chamber 4 has a plug channel 7 in an extension of the thread channel 6, which is formed by a plurality of lamellae 5 that are arranged in an annular manner. The lamellae 5 are held in a housing of the compression chamber 4, in which the conveyor fluid discharged from the plug channel 7 is discharged via a fluid outlet. Each of the synthetic filaments of the thread 8 within the plug channel 7 is deposited on the surface of the thread plug 9 into loops and arcs by means of the conveyor fluid. For this purpose the thread plug 9 continuously moves from the plug channel 7 in the direction of a plug outlet.

A supply unit 15 is provided on the outlet side of the texturing apparatus 1 for the further guiding of the thread plug. In this example embodiment the supply unit 15 is formed by a guide mechanism 11 arranged directly at the compression chamber 4, and a conveyor device 13, which are arranged opposite of a conveyor gap 19. In this manner a retaining force can be created at the thread plug 9, which counteracts the pressure of the conveyor fluid for depositing the thread 8 and for forming the thread plug 9. In this manner a uniform thread plug formation is obtained within the compression chamber 4 and a uniform conveying of the thread plug 9. The conveyor device 13 is embodied as a conveyor roller 14, by which the thread plug 9 is conveyed in a single engagement into the conveyor roller 14. For this purpose the guide mechanism 11 has a slideway 12, on which the thread plug 9 is guided in a sliding manner. The conveyor gap 19 formed between the guide mechanism 11 and the conveyor device 13 is embodied such that the shape of the thread plug 9 is changed so that the forces required for conveying and building up a retaining force can be created at the thread plug 9. For this purpose the guide mechanism 11 is preferably embodied as a guide rail 20, which extends between the texturing apparatus 1 and a processing drum 26 in an L shape. The free end of the guide rail 20 forms a plug outlet 10, which is directly associated with the circumference of the processing drum 20. The slideway 12 in the guide rail 20 is embodied in the shape of an arc, where the conveyor gap 19 is formed in the arc-shaped section of the slideway 12 by the conveyor roller 14 positioned on the opposite side. The conveyor roller 14 is coupled to a motor 18 via a drive shaft 17.

The deflection of the thread plug 9 from the outlet side of the texturing apparatus 1 to the plug outlet 10 is coordinated to the circumference of the processing drum 26 such that the thread plug 9 can be supplied to the processing drum 26 in a substantially tangential manner.

For the thermal treatment the thread plug 9 is deposited in a straight line at the circumference of the processing drum 26. For this purpose the circumference of the processing drum 26 is embodied as a gas permeable guide casing 27. The processing drum 26 is rotationally driven via a drum drive 28. The circumferential speed of the processing drum 26 and the conveyor speed of the thread plug 9 being conveyed via the conveyor device 13 are substantially equal such that the thread plug 9 gathers at the circumference of the processing drum 26 without any change in thickness, and is further conveyed. However, it is also possible to set a circumferential speed via the drum drive 28, which is slightly increased as opposed to the conveyor speed of the conveyor device 13. In this manner a slight loosening of the thread plug is achieved upon gathering on the processing drum 26. An increase of circumferential speed of the processing drum of 5% to 40% as opposed to the conveyor speed of the conveyor device has been proven to be particularly advantageous.

The processing drum 26 is closed on the front sides and is connected to a suction device 30 via a suction connection 29. Low pressure is created in the interior of the processing drum 26 via the suction device 30 such that gaseous fluid may be suction into the interior of the processing drum 26 from the exterior via the guide casing 27. For the treatment of the thread plug 9 the same is deposited on the guide casing 27 of the processing drum 26 and guided at the circumference of the processing drum 26.

For this purpose the processing drum 26 has a guideway 24 on the guide casing 27. The thread plug 9 is guided in multiple wraparounds positioned directly side-by-side. The guide mechanism 11 has a control member 23 on the end facing the processing drum 26, which is positioned on the side of the guide rail 20 opposite of the guideway 12. The control member 23, which is preferably embodied as a sliding edge, has a shape that is adjusted substantially congruent to the guide casing 27 of the processing drum 26, and is held at a short distance above the processing drum 26. The sliding edge extends at a slant to the circumference of the processing drum 26 such that a thread plug exiting at the plug outlet 10 via the slideway 12 and deposited at the circumference of the processing drum 26 is automatically guided against the sliding edge of the sliding device 23 after a straight course on the guideway 24 of the guide casing 27, and is displaced on the guideway 24.

As shown in FIG. 3 the thread plug 9 is axially displaced at the circumference of the processing drum 26 by the sliding device 23. In this manner it is possible to guide the thread plug 9 with multiple wraparounds in the guideway 24 of the guide casing 27, wherein the wraparounds of the thread plug are directly guided side-by-side. In this regard the guide mechanism 11 may be utilized both for guiding the thread plug 9 in front of the processing drum 26 and for guiding the thread plug 9 at the processing drum 26.

In addition to the guideway 24, the guide casing 27 of the processing drum 26 has a cast-off groove 22. The cast-off groove 22 and the guideway 24 are separated from each other at the circumference of the processing drum 26 by a diameter step 34. For this purpose the groove base of the cast-off groove 22 is positioned on a diameter that is slightly smaller than the diameter of the guideway 24. The cast-off groove 22 and the guideway 24 are embodied in a gas permeable manner at the guide casing 27 such that air flows through the guideway 24 and the cast-off groove 22 from the exterior to the interior. Depending on the thread guide a guide zone may be embodied between the cast-off groove 22 and the guideway 24. The guide zone could also be embodied in a gas permeable or gas impermeable manner in order to guide the thread.

A thread guide 31 is connected downstream of the processing drum 26 for guiding a thread at the circumference of the cast-off groove 22. Together with the cast-off groove 22 the thread guide 31, which is formed in this case by a deflection roller, tensions a guide plane of the crimped thread 35 at the circumference of the processing drum 26.

A cast-off mechanism 16 having multiple godet units 32.1 and 32.2 is connected downstream of the thread guide 31 in the guide plane. A twirling unit 33 is provided between the godet units 32.1 and 32.2, which is connected to a compressed air source that is not illustrated. The godet units 32.1 and 32.2 are formed by a driven godet and a non-driven accompanying roller.

In the example embodiment shown in FIGS. 1, 2, and 3 the multifilament thread 8, which, for example, has been removed and stretched directly from the spinning zone, is supplied to the texturing apparatus 1. The thread 8 formed from a plurality of extruded filament strands is conveyed through the conveyor nozzle 6 in the thread channel 6 by way of a hot fluid and guided into the adjoining compression chamber 4. A thread plug 9 is formed within the compression chamber in the plug channel 7, where the filaments of the thread 8 deposit themselves in loops and arcs onto the surface of the thread plug 9. The thread plug 9 is then guided out from the texturing apparatus 1 via the supply unit 15 at a gentle deflection toward the circumference of the processing drum 26. For this purpose a conveyor device 13 engages into the thread plug 9 on one side and conveys the thread plug 9 continuously along the slideway 12 embodied in the guide mechanism 11. The thread plug 9 exits continuously from the plug outlet 10 at a uniform guide speed and is taken up by the rotating processing drum 26. The circumferential speed of the processing drum 26 and the outlet speed of the thread plug are substantially identical such that no loosening of the thread plug 9 occurs. The thread plug 9 is guided at the guideway 24 of the guide casing 27 in multiple wraparounds. For this purpose the wraparounds of the thread plug 9 are positioned side-by-side such that the individual thread plug wraparounds contact each other at the circumference of the processing drum 26.

As shown in FIG. 2, the thread plug 9 is held at the guideway 24 of the guide casing 27 with two wraparounds. After two wraparounds of the thread plug 9 an unraveling area 25 is formed at the circumference of the processing drum 26, in which the thread plug 9 is unraveled into a crimped thread 35. For unraveling the thread plug 9 into the crimped thread 35 in the unraveling area 25 the thread 35 is guided from the unraveling area of the thread plug at a slant. For this purpose a gradient angle is formed between an imagined circumferential line corresponding to the course of the last wraparound of the thread plug 9 at the circumference of the processing drum 26, and the thread 35, which is denoted by the Greek character $\alpha$. The gradient angle $\alpha$ is selected such that with a progressing wrapping around of the thread 35 at the circumference of the processing 26 a continuously increasing axial distance is formed between the thread plug 9 and the crimped thread 35. For this purpose the gradient angle $\alpha$ for guiding the thread 35 may be embodied within a range of 10° to 80°. The gradient angle of the thread can be selected depending on the thickness and guiding of the thread plug 9 in the guide casing 27.

In order to be guided the thread 35 is inserted out from the guideway 24 into the cast-off groove 22. For this purpose the diameter step 34 formed between the guideway 24 and the cast-off groove 22 represents a deflection of the thread 35 at the circumference of the processing drum 26 such that a stable thread guide is ensured out from the unraveling area at a uniform gradient angle. The thread 35 is guided within the cast-off groove 22 at a substantially straight grain in the groove base until the thread separates from the circumference of the processing drum 26 in the cast-off area 36 shown in FIG. 3. The cast-off area 36 and the unraveling area 25 are preferably held toward each other such that a wraparound area occurs for the thread 35 at the processing drum 26, which includes at least one circumferential angle of greater than 45°. In this manner a sufficient thread tension required for the further treatment of the crimped thread 35 can be created.

The crimped thread 35 is twirled in the twirling unit 33 by a compressed air flow for further treatment. In this manner an intensive interweavement of the crimped filaments is achieved, thus particularly improving the coherence of the thread.

Figure 4:
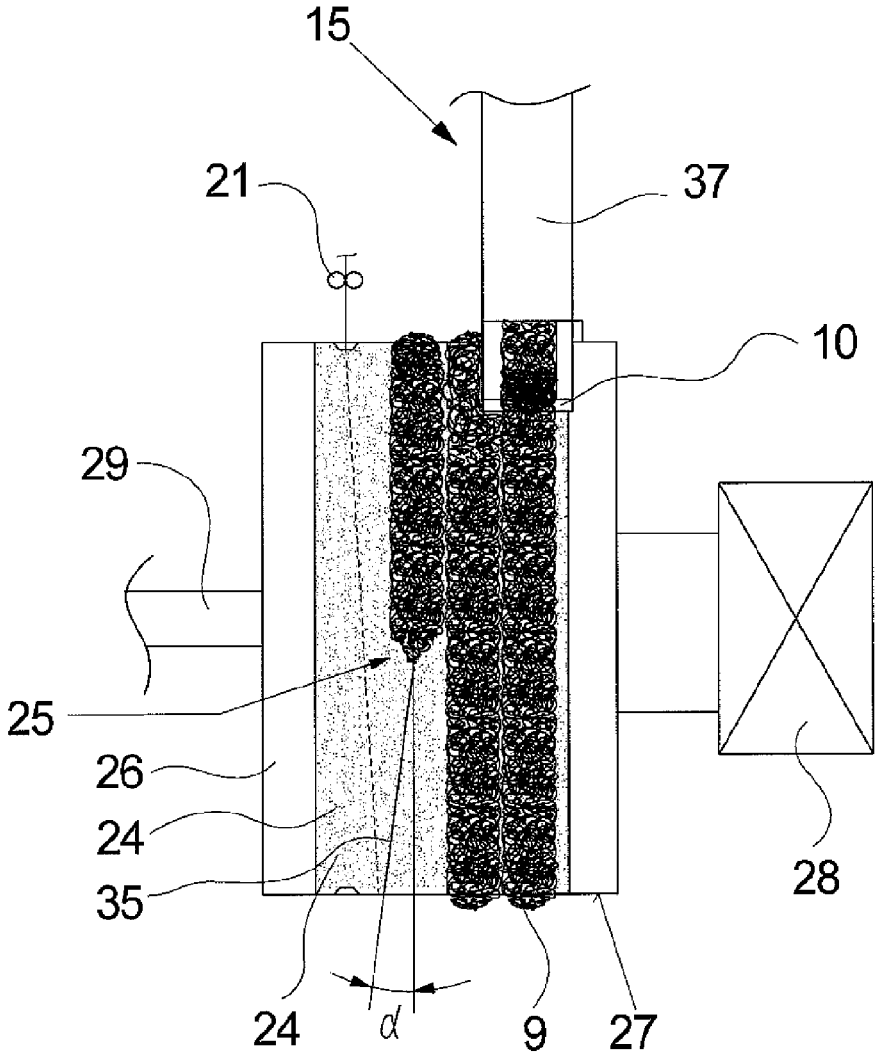
FIG. 4 a schematic side view of a further example embodiment of the device according to the invention.

FIG. 4 shows a further example embodiment of the device according to the present invention for carrying out the method according to the present embodiment of the invention in a schematic side view. The example embodiment of FIG. 4 is substantially identical to the previous example embodiment with regard to construction and function so that only the differences are explained at this point and reference is made to the previous description as to the rest.

The example embodiment of FIG. 4 has a pipe connection 37 as the supply unit 15, which is directly associated with an end of the texturing apparatus (not illustrated). The supply unit 15 is arranged above the processing drum 26, in which a plug outlet 10 directly ends at the circumference of the processing drum 26.

The processing drum 26 has a guideway 24 at the guide casing 27, which is embodied in a gas permeable manner. The guide casing 27 is rotationally driven via the drum drive 28. The guideway 24 at the circumference of the processing drum 26 has a first area for guiding the thread plug 9 in the guide casing 27 and a second area for guiding a crimped thread 35 at an axial offset. A thread guide element 21 is associated with the circumference of the processing drum 26 in the thread guide area of the guideway 24. The thread guide element 21 is arranged at the circumference of the processing drum 26 in the area of the second section of the guideway 24 at an axial offset to an unraveling area 25. A cast-off mechanism (not illustrated) is connected downstream of the thread guide element 21, which is formed in this example embodiment, for example, as an eyelet-shaped thread guide.

In the example embodiment of the device according to the invention shown in FIG. 4 the thread plug 9 is guided with two wraparounds at the circumference of the processing drum after cast off. For unraveling of the thread plug 9 the crimped thread 35 is pulled off the circumference of the processing drum 26 via the thread guide element 21. For this purpose a helical straight grain is created on the guideway 24, which results in an axial distance at the circumference of the processing drum 26 that is formed between the thread plug 9 and the thread 35, which continuously grows with increasing wraparounds of the thread 35 at the guide casing 27. In this manner a removal of the thread 35 from the unraveling area 25 is achieved at a slant. The thread 35 is guided in this helical manner at the circumference of the processing drum 26 at the gradient angle $\alpha$.

For the thermal treatment a tempered gaseous fluid is suctioned in from the exterior through the gas permeable guide casing 27, and discharged into the interior of the processing drum 26. For this purpose the gas permeable area of the guide casing 27 extends across the entire guideway area 24 such that the thread 35 is held at the circumference of the processing drum 26 under suction.

Ambient air is preferably used for cooling an already tempered thread plug 9 guided at the circumference of the processing drum 26 in multiple wraparounds. However, it is generally also possible to suction in and discharge a fluid released in the environment of the processing drum 26 via additional fluid sources, such as for heating the thread plug. In this manner multiple treatment zones may be also advantageously embodied on the processing drum 26 such that the thread plug with a plurality of wraparounds can be treated in multiple steps.

The example embodiments illustrated in FIGS. 1 to 4 each show one processing drum, on which a thread plug having multiple wraparounds is guided. However, it is also generally possible to guide multiple thread plugs side-by-side parallel to each other on a processing drum. Advantageously, the invention also extends to such devices. In this regard it is essential that the crimped thread is guided at the circumference of the processing drum at a gradient angle, which leads to an increase of the axial distance between the thread and the thread plug.

LIST OF REFERENCE SYMBOLS

1 texturing apparatus
2 conveyor nozzle
3 fluid connection
4 compression chamber
5 lamellae
6 thread channel
7 plug channel
8 thread
9 thread plug
10 plug outlet
11 guide mechanism
12 slideway
13 conveyor device
14 conveyor roller
15 supply unit
16 cast-off mechanism
17 drive shaft
18 motor
19 conveyor gap
20 guide rail
21 thread guide element
22 cast-off groove
23 control member
24 guideway
25 unraveling area
26 processing drum
27 guide casing
28 drum drive
29 suction connection
30 suction device
31 thread guide
32.1, 32.2 godet device
33 twirling unit
34 diameter step
35 crimped thread
36 cast-off area
37 pipe connection

What is claimed is:

1. A method for crimping a multifilament thread produced by melt spinning that is compressed to a thread plug, the method comprising:

casting the thread plug onto a circumference of a rotating processing drum for thermal treatment;

wrapping the thread around the circumference of the processing drum with multiple side-by-side wraparounds;

unraveling the thread plug in an unraveling area on the circumference of the processing drum into crimped thread;

guiding the thread at a slant from the unraveling area of the thread plug such that a growing axial distance appears between the thread and the thread plug on the circumference of the processing drum; and pulling the crimped thread off the processing drum.

2. The method according to claim 1, wherein the thread is guided into a cast-off groove on the circumference of the processing drum after unraveling of the thread plug.

3. The method according to claim 1, wherein the thread is guided out from the unraveling area at a gradient angle at the circumference of the processing drum such that an angle of greater than 10° is created between a straight grain and a circumferential line of the processing drum.

4. The method according to one claim 1, wherein the thread is guided on the circumference of the processing drum between the unraveling area and a cast-off area via a wraparound area, which includes at least one circumferential angle of 45°.

5. The method according to claim 1, further comprising the step of twirling the crimped thread after the crimped thread is cast-off from the processing drum.

6. The method according to claim 1, wherein the thread plug is conveyed by a conveyor device in order to cast the thread on the circumference of the processing drum, wherein the conveyor device and the processing drum are driven independently of each other.

7. The method according to claim 6, wherein the thread plug includes a substantially straight plug course that is cast on the circumference of the processing drum.

8. The method according to claim 7, further comprising the step of axially displacing the thread plug on the circumference of the processing drum for a transition from a first wraparound to a directly adjacent second wraparound.

9. A device for crimping a multifilament thread produced by melt spinning, the device comprising:

a texturing apparatus constructed and arranged to form a thread plug having at least one multifilament thread produced by melt spinning;

a rotationally driven processing drum having:

a. a circumference constructed and arranged to receive the thread plug for thermal treatment;

b. an unraveling area on the circumference of the drum where the thread plug is unraveled into crimped thread; and c. a cast-off mechanism constructed and arranged to cast the crimped thread from the circumference of the processing drum;

means for guiding the crimped thread at the circumference of the processing drum at a slant from the unraveling area; and wherein the thread plug is guided at the circumference of the processing drum with multiple wraparounds and wherein with an increase of wraparounds of the thread at the circumference of the processing drum an increased axial distance is formed between the crimped thread and the thread plug at the circumference of the processing drum.

10. The device according to claim 9, wherein the means is a thread guide element that is arranged at a distance to the processing, which is associated with the circumference of the processing drum at an axial offset to a guideway receiving the thread plug.

11. The device according to claim 9, wherein the means is a cast-off groove at the circumference of the processing drum, wherein the cast-off groove is arranged on the circumference of the processing drum at an axial offset to a guideway receiving the thread plug.

12. The device according to claim 10, further comprising a diameter step embodied on the circumference of the processing drum between the cast-off groove and the guideway, wherein the diameter step guides the thread at a slant on the circumference of the processing drum such that an angle of greater than 10° is created between a straight grain and a circumferential line of the processing drum.

13. The device according to claim 12, further comprising a thread guide element associated with the processing drum, the thread guide element tensioning a guide plane with the cast-off groove and creating a wraparound area of the crimped thread, which includes at least one circumferential angle of 45° at the circumference of the processing drum.

14. The device according to claim 11, further comprising a supply unit disposed between the texturing apparatus and the processing drum, the supply unit being operatively associated with a plug outlet of the guideway at the circumference of the processing drum.

15. The device according to claim 14, wherein the supply unit includes a guide mechanism and a conveyor device, which are combined into a conveyor gap such that the thread plug is guided by engagement of the conveyor device on one side along the slideway formed by the guide mechanism.

16. The device according to claim 15, wherein the conveyor device includes a driven conveyor roller, which abuts the thread plug with a rotating conveyor casing, and wherein the guide mechanism includes a guide rail, the one-sided slideway, of which is arranged opposite of the conveyor roller for forming the conveyor gap.

17. The device according to claim 15, further comprising a control member is arranged in the rotating direction of the processing drum at a short distance in front of the guide mechanism.

18. The device according to claim 9, wherein the circumference of the processing drum is formed by a gas permeable guide casing, which is connected to a suction device, such that low pressure acting upon the environment can be created in the interior of the processing drum.

19. The device according to claim 9, further comprising a twirling unit connected downstream of the processing drum, the twirling unit being constructed and arranged to twirl the filaments of the multifilament thread after crimping.

20. The device according to claim 9, wherein the texturing apparatus is formed by a conveyor nozzle and a compression chamber associated with the conveyor nozzle on an outlet side, and wherein the conveyor nozzle is connected to a compressed air source.

* * * * *

UNITED STATES PATENT AND TRADEMARK OFFICE

CERTIFICATE OF CORRECTION

PATENT NO. : 7,712,197 B2
APPLICATION NO. : 12/433413
DATED : May 11, 2010
INVENTOR(S) : Mathias Stündl It is certified that error appears in the above-identified patent and that said Letters Patent is hereby corrected as shown below:

Claim 4, Column 10, Line 40, "The method according to one claim 1," should read -- The method according to claim 1, --.

Signed and Sealed this

Sixth Day of July, 2010

David J. Kappos

David J. Kappos
*Director of the United States Patent and Trademark Office*